US005779539A

United States Patent [19]

Kolt

[11] Patent Number: 5,779,539

[45] Date of Patent: Jul. 14, 1998

[54] STATIC VENTING SYSTEM

[76] Inventor: Stanley Kolt, 4 Country Rd., Mamaroneck, N.Y. 10543

[21] Appl. No.: 755,409

[22] Filed: Nov. 22, 1996

[51] Int. Cl.[6] ..... F24F 7/00

[52] U.S. Cl. ..... 454/368; 454/39

[58] Field of Search ..... 454/3, 12, 35, 454/39, 366, 367, 368

[56] References Cited

U.S. PATENT DOCUMENTS

| | | | |
|---|---|---|---|
| 1,784,783 | 12/1930 | Cauchemont | 454/39 X |
| 2,522,995 | 9/1950 | Coleman | 454/39 |
| 2,737,876 | 3/1956 | Smith | 454/368 |

*Primary Examiner*—Harold Joyce

*Attorney, Agent, or Firm*—Leonard W. Suroff

[57] ABSTRACT

A static venting system includes a first larger geometrically-shaped member having a plurality of outwardly extending vertical louvers with a top margin and a bottom margin; a second smaller geometrically-shaped member is disposed within the larger member and has a plurality of outwardly extending vertical louvers and a top margin and a bottom margin; a cap member is provided with a first portion for affixing the cap member to the top margin of one of the first or second geometrically-shaped member; the base member has a centrally disposed aperture, a portion for affixing the top margin of the other of said geometrically-shaped members thereto and an outwardly extending flange portion for affixing the base member over a vent aperture provided in an external surface; and a means for connecting the base member to the cap member.

15 Claims, 7 Drawing Sheets

62

28
30
68
64
10
62
60
39
36
66
64
64
58
64
52

STATIC VENTING SYSTEM

1. FIELD OF THE INVENTION

The present invention relates to vents, and more particularly, to a static ventilation system suitable for mounting on an inclined, vertical or flat external surface.

2. DISCUSSION OF THE RELEVANT ART

A typical ventilation structure is disclosed in U.S. Pat. No. 2,737,876 issued to L. L. Smith on Mar. 13, 1956. The apparatus disclosed herein is suitable for use on either a pitched or flat roof. However, it is not suitable for use on a vertical wall.

Another type of roof ventilator is disclosed in U.S. Pat. No. 3,238,862 which issued to L. L. Smith, et. al. on Mar. 8, 1966. The device disclosed therein appears to be an improvement of the earlier device. However, there is no mention therein of using the device on a vertical external wall. Another roof ventilator is disclosed in U.S. Pat. No. 2,359,716 issued to N. T. McKenzie, et. al. on Oct. 3, 1994. The apparatus disclosed therein utilizes vertical vanes or louvers and is relatively inexpensive to manufacture. However, this device is suitable for use only on the peak of a building, since using it on a sloped surface would not prevent rain from entering therein.

Therefore, it is an object of the present invention to provide a static ventilator suitable for use on any type of external surface to vent the air disposed therein.

It is another object of the present invention to provide a static venting system that has no moving parts and may be used to vent trapped air within a room.

It is still yet another object of the present invention to provide a means for venting air to the outside from a room with only a vertical external wall available.

It is still yet another object of the present invention to provide a static venting system which is more effective in moving air to the atmosphere than other static venting devices.

SUMMARY OF THE INVENTION

The present device overcomes the shortcomings found in the prior art and includes a first circularly-shaped member having a plurality of outwardly extending vertical louvers with a top margin and a bottom margin; a circularly-shaped cap member having a portion for affixing the cap member to the top margin of the first member and a co-axially ridge disposed remote from the outer edge of the cap member; a second member has a plurality of outwardly extending vertical louvers provided with a top margin and a bottom margin. The second circularly shaped bottom margin is capable of being received by and cooperate with the cap member ridge. A base member has a centrally disposed aperture, a portion for affixing the top margin of the second member to it and a outwardly extending flange for affixing the base member over a vent aperture provided in an external surface.

The foregoing and other objects of the invention will appear in the description to follow. In the description, reference is made to the accompanying drawings, which form a part hereof, and in which is there is shown, by way of illustration, various embodiments in which the invention may be practiced. These embodiments will be described in sufficient detail to enable those skilled in the art to practice the invention. It is to be understood that other embodiments may be utilized and that structural changes may be made without departing from the spirit and scope of the present invention. The following description is therefore, not to be taken in the limiting sense and the scope of the present invention is best defined by the appended claims.

BRIEF DESCRIPTION OF THE DRAWINGS

In order that the invention may be more fully be understood, it will now be described by way of example, with reference to the accompanying drawings in which.

DESCRIPTION OF THE PREFERRED EMBODIMENTS

Figure 1:
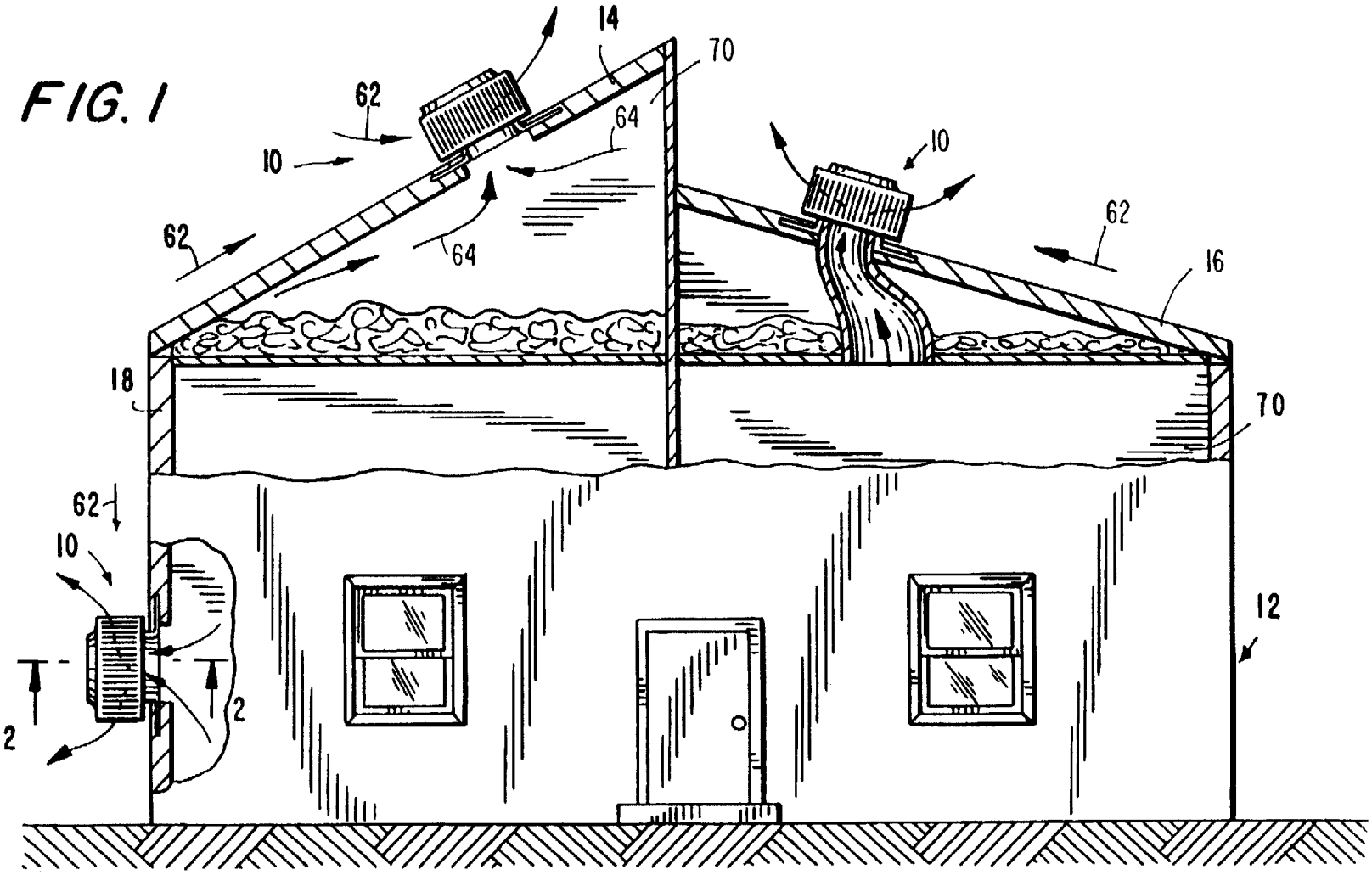
FIG. 1 is a pictorial representation of a home, partially broken away, showing the different positions for the static venting system which, may be used on an external sloped wall, vertical wall or an essentially flat or external roof of a house, according to the principals of the present invention.

Referring now to the figures, and in particular to FIG. 1, there is shown a static venting system 10, according to the principles of the present invention, positioned at various places on a typical house 12, e.g. the sloped roof 14, an essentially flat roof 16 and a vertical wall 18 as would be found in a typical kitchen, not shown.

Figure 2:
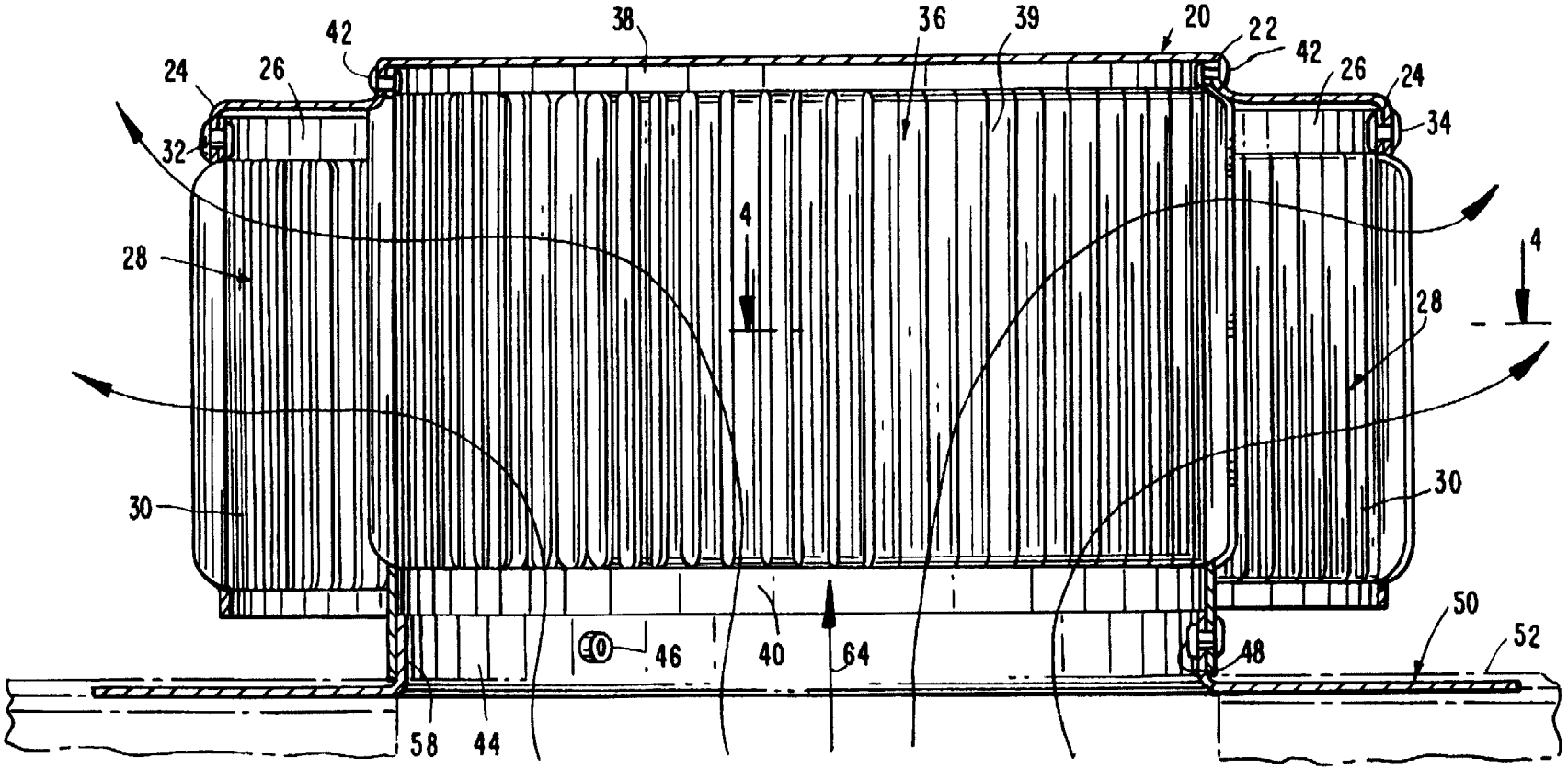
FIG. 2 is a greatly enlarged cross-sectional view, in elevation, of the venting system taken along the line 2—2 in FIG. 1.
Figure 3:
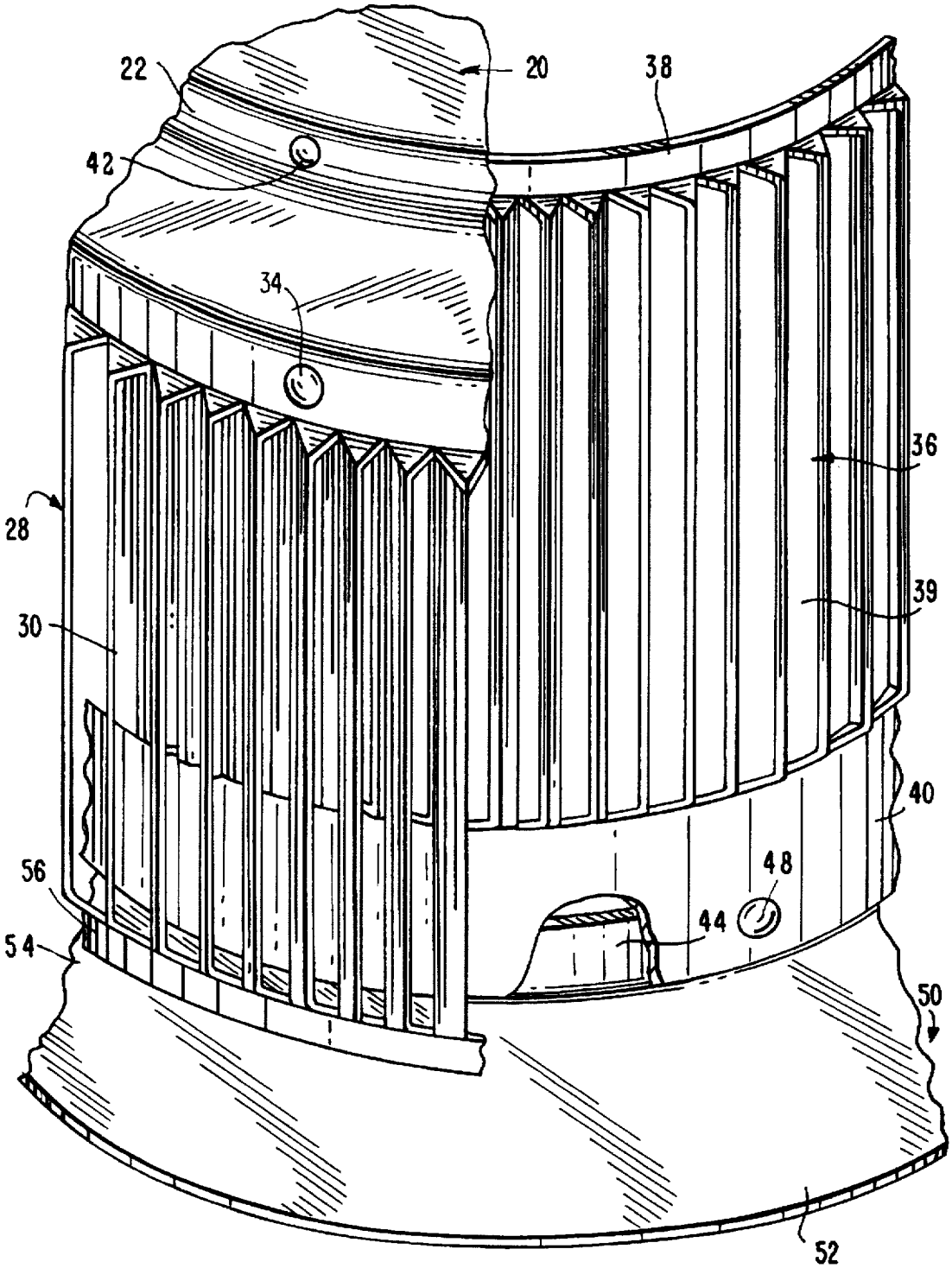
FIG. 3 is a greatly enlarged perspective view, of a portion of the static venting system shown in FIG. 1.

Referring now to FIG. 2, which is a greatly enlarged view of the static venting system 10 taken essentially along the lines 2—2 of FIG. 1. It can be seen that the venting system 10 includes a cap member 20 that is provided with a circularly-shaped ridge or depression 22 and a lip portion 24, which may be utilized to affix the cap member 20 to the top margin 26 of a first member 28 that is provided with a plurality of outwardly extending louvers 30. The method of affixing cap member 20 to the first member 28 may be a typical nut and screw arrangement 32 or a rivet 34, or a spot weld, not shown. A second member 36 is provided with a top margin 38 and a bottom margin 40. The top margin 38 is affixed to the cap member 20 by means of the rivets 42 in the ridge or depression 22. The bottom margin 40 of the second circularly-shaped member 36 is riveted to an upstanding circular portion 44 by means of the rivets 46 and 48 provided in the base member 50. The base member 50 is also provided with an extended portion 52, which acts as flashing when it is affixed to the external wall 16 of a house 12.

Once the unit is assembled, the edge 54 of bottom margin 56 of the first member 28 is preferably one-half inch above the extending lip portion 52 of base member 50. The base member 50 is also provided with a centrally disposed aperture 58, which is placed over an opening in an external wall or roof when the static venting system 10 is installed.

Figure 4:
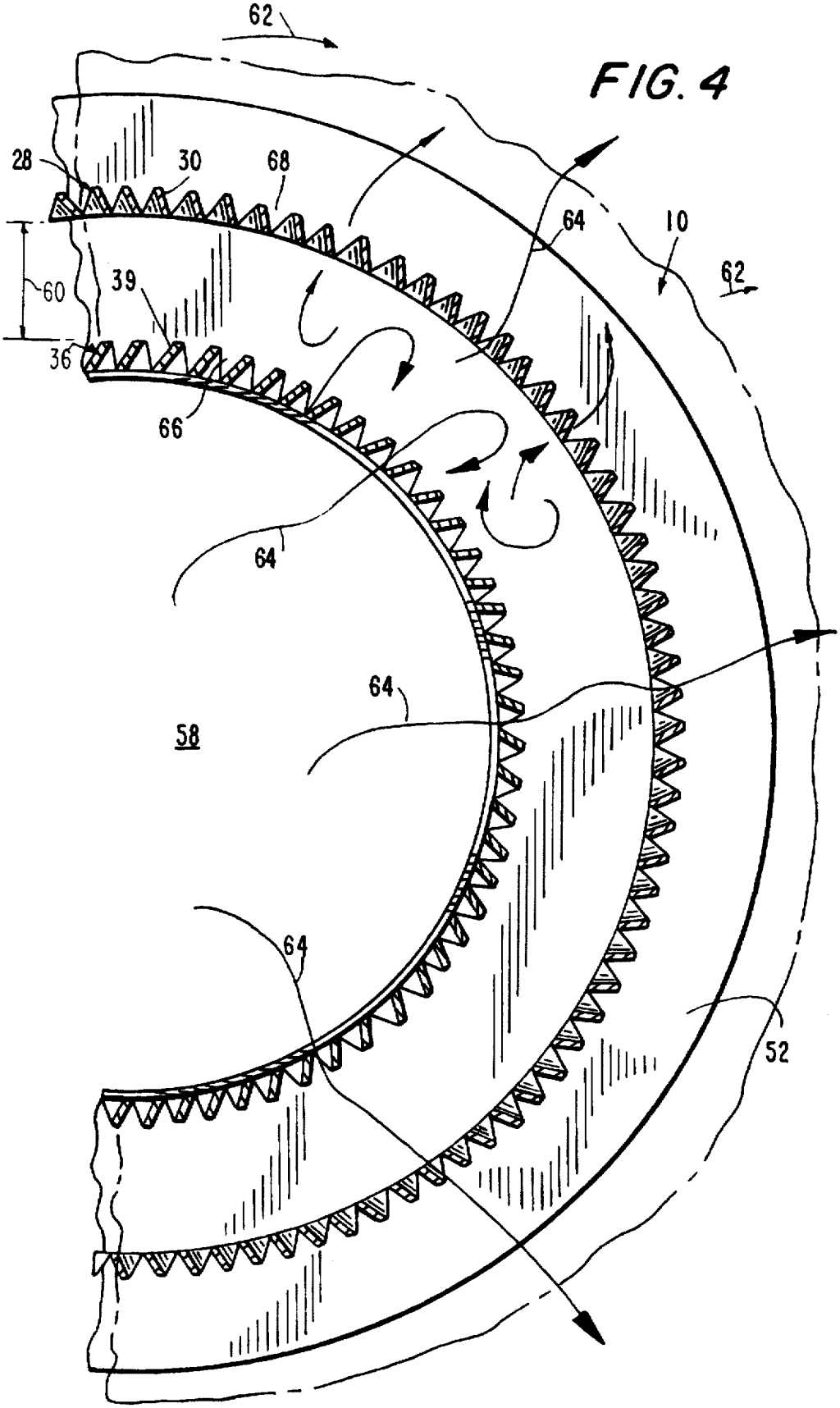
FIG. 4 is a greatly enlarged top plan view of a portion of the static venting system taken along the line 4—4 of FIG. 2.

Referring now to FIG. 4, which is a greatly enlarged partial top plan view taken along the line 4—4 of FIG. 2 showing the positioning of the large diameter circular shaped member 28 with its outwardly extending louvers 30 and the small diameter circularly-shaped member 36 with its outwardly extending louvers 39. The distance 60 between the louvers 30 and 39 is preferably approximately three inches.

The external air flow shown by arrows 62 flowing along the sloped roof 14 and/or flat roof 16 (See FIG. 1) creates a negative pressure around the surface when it is deflected away from the surface by coming into contact with the static venting system 10. The lower pressure causes the air coming up through aperture 58, indicated by arrows 64, to move from the higher pressure area at aperture 58 to the space 66 between the louvers 30 and 39. The air is then caused to flow through the space 72 provided between in the members 28 and 36, where it becomes turbulent and exits, via the space 68 provided in louver 30 and speeded up by the outside air flow shown by the arrows 62, thereby continuously drawing the air 64 from the higher pressure air appearing at aperture 58 of venting system 10. This continuous air movement draws the internal air from the room or attic 70, removing the stale air or air having undesirable odors to the outside.

Figure 5:
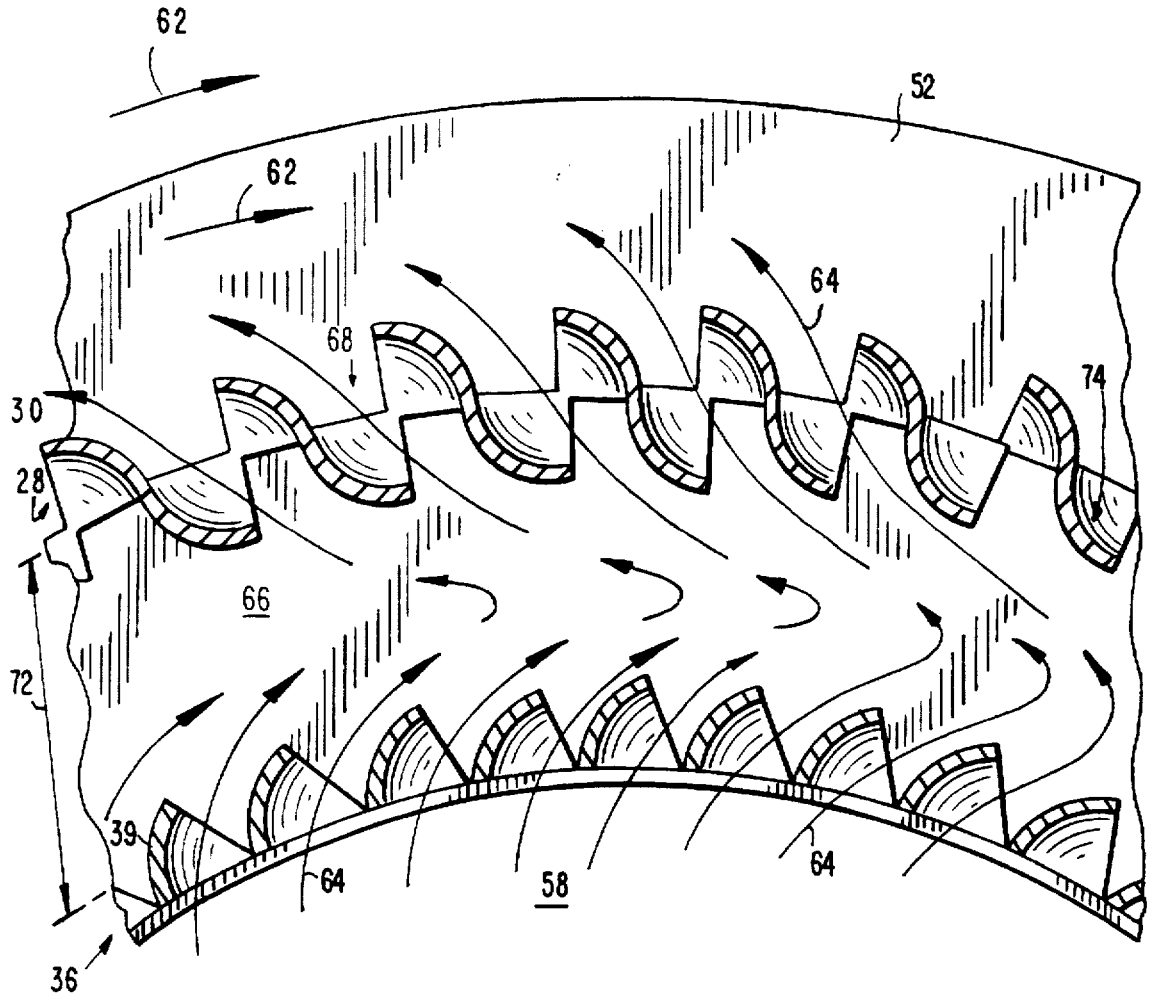
FIG. 5 is a portion of greatly enlarged top plan view of an alternative embodiment of the present invention.

Referring now to FIG. 5 which shows an alternative embodiment wherein the louvers 30 of the first circular shaped member 28 and the louvers 39 of the second circular-shaped member 36 are greatly enlarged. The external air flow 62 travelling at a higher velocity than the stagnant air within the building causes a lower pressure to exist when it comes into contact with the outer louvers of the static venting system 10 thereby causing the air from a room or attic to flow through aperture 58 causing turbulence in the space 72 between the louvers 30 and 39 of the first member 28 and the second member 36 thereby causing turbulence within the space 66. It is this turbulence occurring in the space 66 that causes the air to flow out between the space provided by the louvers as shown in FIG. 5. The louvers 30 and 39 may be slightly curved to enhance the air flow. A third member 74 is affixed to the first circularly-shaped member 28 thereby extending the louvers 30 to twice its normal width and increasing the air flow through the space between the louvers 68, since it extends further into the turbulence. The third member 74 also serves to prevent rain from entering into the static venting system 10 and into aperture 58.

Figure 6:
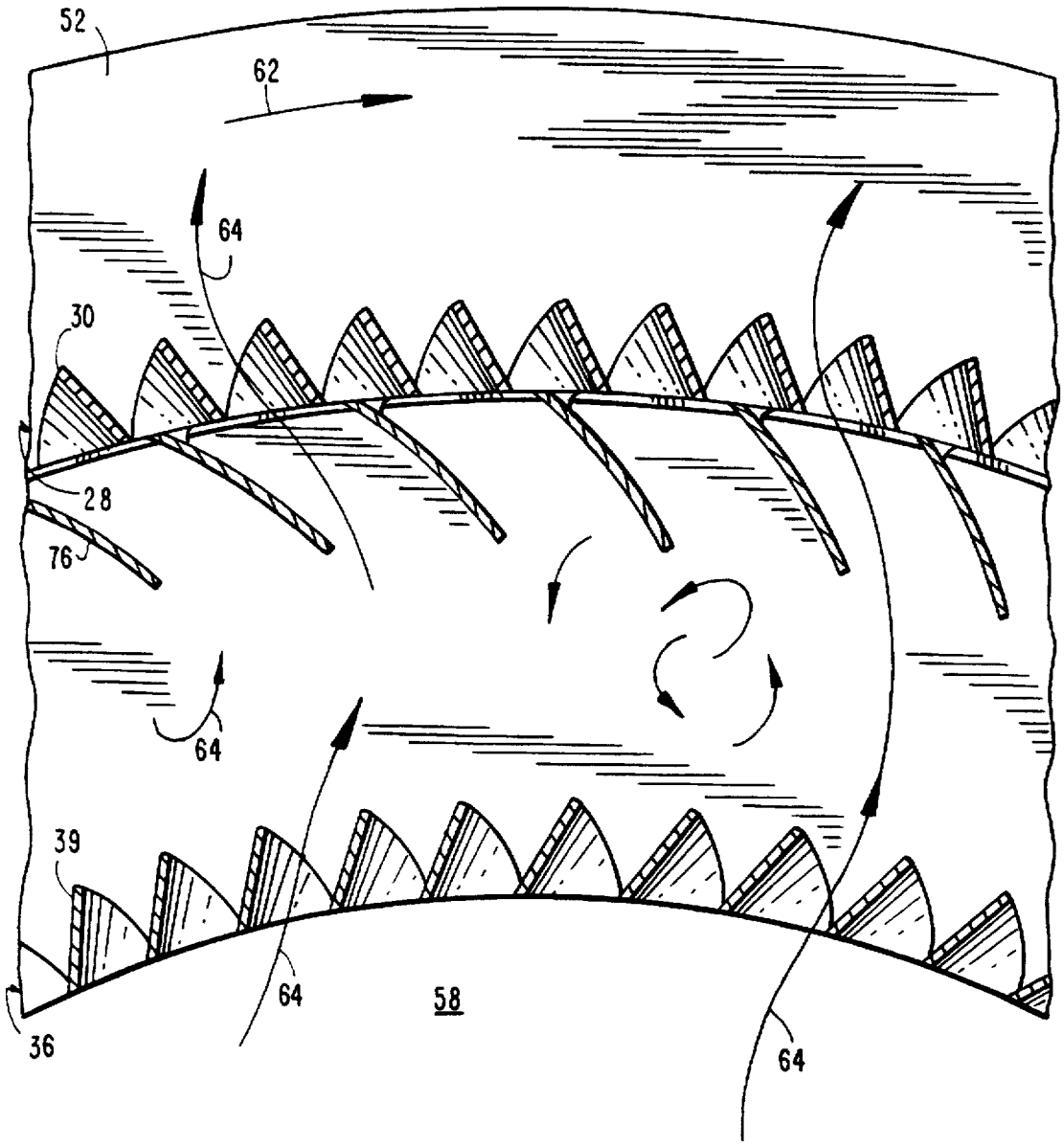
FIG. 6 is a portion of greatly enlarged top plan view of another alternative embodiment of the present invention.

Referring now to FIG. 6, which functions in an manner similar to that described for FIG. 5. The third member 74 has louvers thereon, which are randomly spaced around the first member 28 and extend further into the turbulent area therefore capturing more of the air flowing up through aperture 58 and out into the air stream 62. The addition of a third circular shaped member increases the protection from random sprinklings of rain which may enter the louvers when the static venting system 10 is installed in climates where there is frequent heavy driven rain storms.

Figure 7:
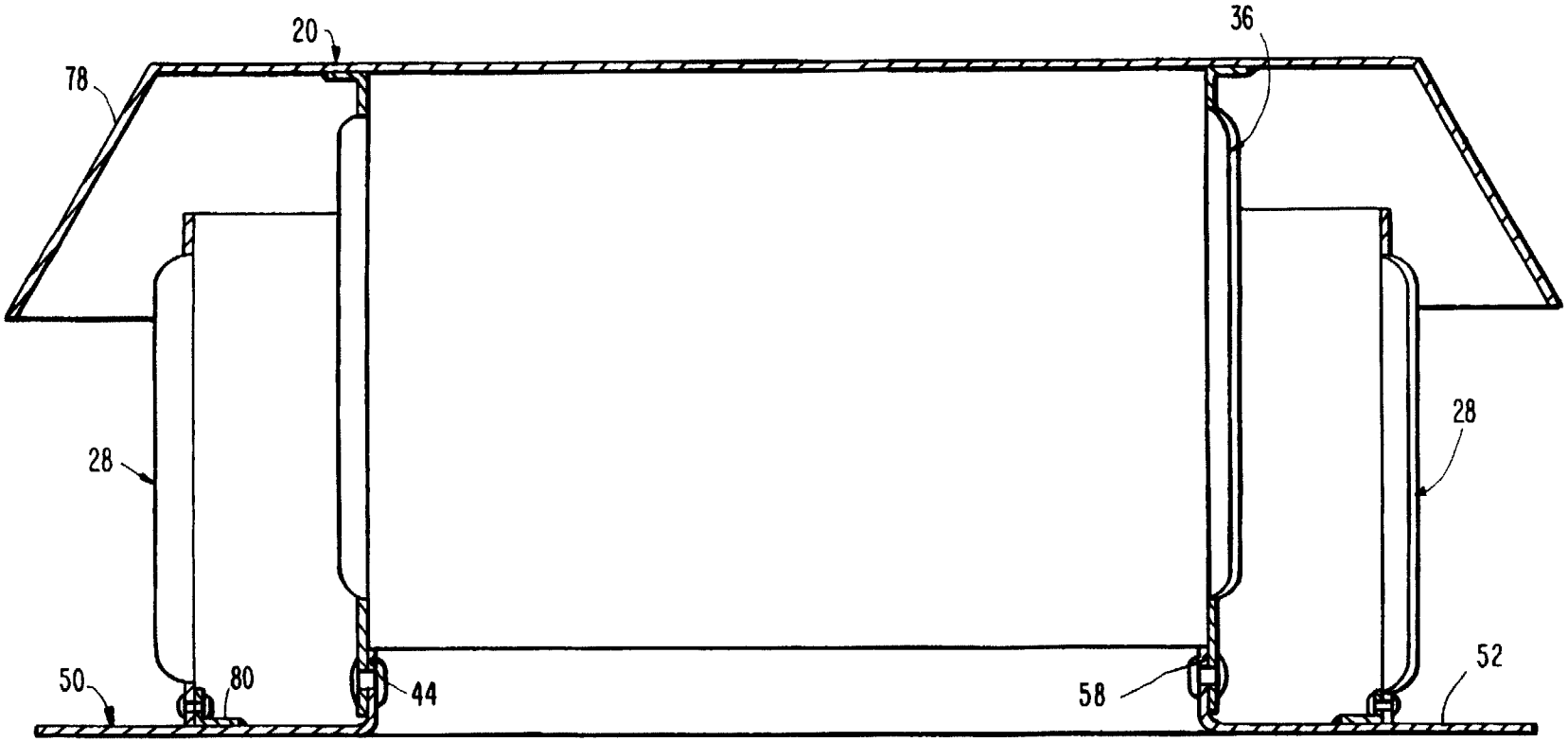
FIG. 7 is a simplified cross-sectional view in elevation of yet another alternative embodiment of the present invention.

Referring now to FIG. 7 which discloses an alternative embodiment of the subject invention. It is shown in a simplified arrangement so that one may follow the construction more readily. As shown therein, the cap member 20 is provided with an extending overhanging portion 78 and is fixed to the second member 36, which is provided with a ridge or depression 22 for affixing the second member 36 to the cap member 20 in a manner similar to that described earlier. The other end or bottom margin of the second member is provided with an extending portion to enable it to be affixed to a base member 50 that is provided with an aperture 58. The bottom margin 40 of the second member 36 is affixed to an upstanding portion 44 provided in the base member. The larger member 28 is affixed to the base member 50 in a second ridge portion 78 provided on the base member 50. This embodiment provides additional protection against rain entering into the aperture 58 and functions in the same manner as the earlier embodiment by providing turbulence occurring between the smaller circularly-shaped member 28 and the larger circularly-shaped member 36 to flow out of the louvers provided in the member 28 and/or the space within the overhanging lip portion 78 of the cap member 20 and member 28.

Tests were performed on the device disclosed in the instant invention and compared to a 144 square inch round conventional static cap. For the conventional cap the data shows little or no movement of intake air at aperture 58 with the outside air flow set around the cap at 7 miles per hour (mph) flowing down on the cap at a 45 degree angle. When the outside air flow was increased to 15 mph the intake air increased to 240 cubic feet per minute (cfm), with little or no movement of intake air at aperture 58 until then.

Similar tests were run on an 8 and 14 inch diameter static venting system manufactured according to the principles present invention. For the 8 inch static venting system, the data indicated that with the outside air flowing at 7, 10 and 15 mph the intake air at aperture 58 was approximately 115 cfm, 170 cfm, and 275 cfm, respectively. For the 14 inch static venting system, the data shows that the intake air at aperture 58 was approximately 100 cfm, 155 cfm, and 240 cfm, respectively. The data clearly indicates that the instant invention provides an improved venting capacity when compared to a conventional static vent.

To manufacture the instant invention, the first and second members may be manufactured essentially identical with the smaller diameter member being inverted when assembled so that the louvers are going in the opposite direction from those of the smaller diameter member. The cap member is affixed to the larger member along the top margin and the smaller member is placed inside the larger diameter member in a telescoping manner. The smaller diameter member is affixed to the cap along the top margin and is affixed to the base member at the bottom margin thereof leaving a space of at least one-half inches above the bottom margin of the larger member. The unit is inserted over an aperture provided in a roof or outside wall utilizing the base extending portion 52 to act as flashing together with the siding on the roof or wall so that the water can not enter the aperture 58 provided in the roof or wall of the building.

Hereinbefore has been disclosed a simple inexpensive static venting system, which is capable of providing more exhaust air flow than conventional devices with the exhausting capability increasing with the external air flow across the static venting system.

Having thus set forth the nature of the invention, what is claimed is:

1. A static venting system comprising:

A. a first larger geometrically-shaped member having, a) a plurality of outwardly extending vertical louvers, and b) a top margin and a bottom margin;

B. a second smaller geometrically-shaped member disposed within said larger member having, a) a plurality of outwardly extending vertical louvers, and b) a top margin and a bottom margin;

C. a cap member provided with, a) a first portion for affixing said cap member to the top margin of said first geometrically-shaped and a second portion for affixing said cap member to the top margin of said second geometrically-shaped member;

D. a base member, said base member having, a) a centrally disposed aperture, b) a portion for affixing said bottom margin of one of said first or said second geometrically-shaped members thereto, and c) means for affixing said base member over a vent aperture provided in an external surface; and E. means for connecting said base member to said cap member.

2. A static venting system, according to claim 1, wherein the distance between said first larger geometrically-shaped member and said second smaller geometrically-shaped member is preferably approximately three inches.

3. A static venting system, according to claim 1, wherein the space between said first larger geometrically-shaped member and said second smaller geometrically-shaped member is between two and five inches.

4. A static venting system, according to claim 1, further including a third geometrically-shaped member having, a) a plurality of inwardly extending vertical louvers, and b) a top margin and a bottom margin;

said third member being disposed relative to said larger geometrically-shaped member so that said vertical louvers of said third member are in alignment with each of said plurality of outwardly extending vertical louvers of said larger member extending the width of said larger member louvers.

5. A static venting system, according to claim 1, further including a third geometrically-shaped member having, a) a plurality of inwardly extending vertical louvers, and b) a top margin and a bottom margin;

said third member being disposed relative to said larger geometrically-shaped member so that said vertical louvers of said third member are not in alignment with each of said plurality of outwardly extending vertical louvers of said larger member.

6. A static venting system, according to claim 1, wherein said geometrically-shaped members are generally circularly shaped in a plan view thereof.

7. A static venting system, according to claim 1, wherein said cap member further includes an outwardly extending portion that extends outwardly and downwardly beyond said first larger geometrically-shaped member.

8. A static venting system, according to claim 1, wherein said second smaller geometrically-shaped member is provided with an extending lip portion for affixing said smaller geometrically-shaped member to said cap member.

9. A static venting system, according to claim 1, wherein said first larger geometrically-shaped member is provided with an extending lip portion for affixing said larger geometrically-shaped member to said base member.

10. A static venting system comprising:

A. a first member having, a) a plurality of outwardly extending vertical louvers and a top margin and a bottom margin;

B. a cap member having a circumference and provided with, a) a portion for affixing said cap member to the top margin of said first member, and b) a coaxial ridge disposed remote from the circumference of said cap member;

C. a second member having, a) a plurality of outwardly extending vertical louvers provided with a top margin and a bottom margin, said second top margin being capable of being received by and cooperate with said cap member ridge; and D. a base member, said base member having, a) a centrally disposed aperture, b) a portion for affixing the bottom margin of said second member thereto and c) a flange for affixing said base member over a vent aperture provided in an external surface.

11. A static venting system, according to claim 10, wherein the distance between said first member and said second member is preferably approximately three inches.

12. A static venting system, according to claim 10, wherein the space between said first member and said second member is between two and five inches.

13. A static venting system, according to claim 10, further including a third member having, a) a plurality of inwardly extending vertical louvers, and b) a top margin and a bottom margin; said third member being disposed so that said vertical louvers are in alignment with said first member louvers, said plurality of inwardly extending vertical louvers extending the width of said outwardly extending louvers.

14. A static venting system comprising:

A. a first member having, a) a plurality of outwardly extending vertical louvers and a top margin bottom margin;

B. a cap member having a circumference and provided with, a) a lip portion for affixing said cap member to the top margin of said first member, and b) a coaxial protruding ridge disposed approximately three inches from the circumference of said cap member;

C. a second member having, a) a plurality of outwardly extending vertical louvers provided with a top margin and a bottom margin, said second top margin received into and cooperating with said cap member ridge; and D. a base member, said base member having, a) a centrally disposed aperture, b) a portion for affixing the bottom margin of said second member thereto, and c) an outwardly extending flange for affixing said base member over a vent aperture provided in an external surface.

15. A static venting system, according to claim 14, wherein said base member is circularly-shaped.

* * * * *